United States Patent [19]

Weisenburger

[11] Patent Number: 4,797,112

[45] Date of Patent: Jan. 10, 1989

[54] WIRE HOLDERS AND HARNESSES INCORPORATING WIRE HOLDERS

[75] Inventor: Lawrence P. Weisenburger, Kernersville, N.C.

[73] Assignee: AMP Incorporated, Harrisburg, Pa.

[21] Appl. No.: 81,195

[22] Filed: Aug. 4, 1987

[51] Int. Cl.[4] ..... H01R 13/00

[52] U.S. Cl. ..... 439/55; 439/65

[58] Field of Search ..... 439/55, 59, 60, 61, 439/62, 65, 71, 629, 630, 631, 632, 792

[56] References Cited

U.S. PATENT DOCUMENTS

| | | | |
|---|---|---|---|
| 3,315,217 | 4/1967 | Bird | 439/630 |
| 3,459,878 | 8/1969 | Gressitt et al. | 174/112 |
| 3,758,935 | 9/1973 | Long et al. | 29/566.4 |
| 3,800,390 | 4/1974 | Johnston | 29/749 |
| 3,861,775 | 1/1975 | Makins | 439/59 |
| 3,866,296 | 2/1975 | Tucci | 29/749 |
| 3,953,916 | 5/1976 | Rolland et al. | 29/566.3 |
| 3,958,853 | 5/1976 | Wilson | 439/398 |
| 3,960,425 | 6/1976 | Kirk, Jr. et al. | 439/55 |
| 3,987,531 | 10/1976 | Tucci | 29/748 |
| 4,035,897 | 7/1977 | Over et al. | 29/56.6 |
| 4,093,334 | 6/1978 | Wickenberg et al. | 439/459 |
| 4,516,822 | 5/1985 | Wolfel | 439/458 |
| 4,601,530 | 7/1986 | Coldren et al. | 439/460 |
| 4,719,321 | 1/1988 | Kozel et al. | 174/135 |

*Primary Examiner*—Eugene R. LaRoche
*Assistant Examiner*—Steven J. Mottola
*Attorney, Agent, or Firm*—Robert W. Pitts; Frederick W. Raring

[57] ABSTRACT

Wire holder for holding discrete wires in side-by-side parallel coplanar aligned relationship comprises a rectangular frame having oppositely-facing major surfaces and oppositely-facing minor surfaces. Side-by-side wire-receiving cavities extend into one of the major surfaces and through the frame and between the minor surfaces, a removable wire guard is connected to the frame and extends beside one of the minor surfaces. Wires inserted into the cavities will have projecting tip portions which will be located in the clearance space between the guard and the adjacent minor surface. Use of the wire holder has the effect of conferring on discrete wires may of the desirable features of flat conductor cable.

21 Claims, 6 Drawing Sheets

WIRE HOLDERS AND HARNESSES INCORPORATING WIRE HOLDERS

FIELD OF THE INVENTION

This invention relates to wire holders for holding discrete wires in side-by-side parallel coplanar relationship and relates to electrical harnesses incorporating wire holders.

BACKGROUND OF THE INVENTION

It is common practice to manufacture electrical harnesses with conductor cable or ribbon cable, as it is sometimes called, which comprises a plurality of side-by-side, parallel, spaced-apart conductors contained in a ribbon of insulating material. Flat conductor cable has several advantages as compared with discrete wire cables such as the fact that each conductor occupies a predetermined position in the cable with reference to the other conductors and a specific conductor can be identified at any position along the length of the cable. A further advantageous feature of flat conductor cable is that electrical connections can be made to all of the conductors in a cable by simply installing a multicontact electrical connector having terminals therein which are spaced apart by the same distances as the conductors in the cable. The terminals of such connectors are usually of the insulation displacement type and the installation of the connector on the cable merely requires that the connector be placed in alignment with the cable and the cable pushed against the terminals in the connector. A wide variety of connectors are available for the many types and sizes of flat conductor cable available.

Flat conductor cable has, however, several shortcomings as compared with discrete wires and discrete wires also have comparative advantages which are not realized when flat cables are used rather than discrete wires in a harness manufacturing operation. For example, the cost of flat conductor cable is almost always significantly greater than the cost of a cable having a comparable number of discrete wire conductors therein. A further comparative disadvantage is that flat conductor cables are available from cable manufacturers only in specific sizes and wire gauges and if a manufacturer of harnesses wishes to produce a cable having a number of conductors therein which is more or less than the conductors available in a standard cable, he is required to use a cable containing conductors beyond the number he requires for the harness. This is an undesirable expedient for the reasons that it is wasteful and it is not desirable to have surplus conductors in the harness which might cause confusion to a technician making repairs to the equipment on which the harness is used. Also, it is sometimes required that a harness have one or two conductors therein which are of a wire gauge which is greater than the gauge of the remaining wires in the conductor and standard off-the-shelf flat cables are generally not available with different sizes or gauges of conductors in the cable. A further comparative shortcoming of flat conductor cable is that it is impractical to form branches or "break outs" in the harness which may be required when some of the conductors in the cable must go to a first connector and the remaining conductors must go to a second connector at a location remote from the first connector. It is generally not advisable to try to slit flat conductor cable between adjacent conductors for the reason that the insulation may be damaged and the electrical integrity of the cable thereby compromised.

The present invention is directed to the achievement of a wire holder or wire fixture for discrete wires which confers on discrete wire cables and harnesses, many of the advantages of flat conductor cable without sacrifice of the particular advantages of discrete wires. The invention is further directed to the achievement of electrical harnesses having discrete wires therein which have the advantages of harnesses composed of flat conductor cable.

THE INVENTION

The invention comprises a wire holder for holding a plurality of discrete wires in an array in side-by-side parallel relationship. In accordance with one embodiment, the wire holder comprises a frame having oppositely-facing first and second major surfaces, oppositely-facing first and second minor surfaces, and oppositely-facing ends. The major surfaces and the minor surfaces extend between the ends and normally thereof. A plurality of side-by-side wire-receiving cavities extend into the first major surface and extend through the frame from the first minor surface to the second minor surface. The cavities are in a row which extends between the ends and each cavity has wire retaining means therein for retaining wires inserted into the cavities. A wire guard is provided for protecting the tip portions of the end portions of wires which are contained in the cavities. The guard extends beside, and is spaced from the first minor surface so that clearance space is provided between the guard and the first minor surface for the tip portions of the wires in the cavities. A wire can thus be positioned in an individual cavity by positioning the wire adjacent to the first major surface with the axis of the wire in alignment with the cavity and with the tip portion of the end portion of the wire aligned with the clearance space between the guard and the first minor surface. The wire is thereafter moved laterally of its axis and into the cavity so that the wire is retained in the cavity with the tip portion of the wire projecting from the first minor surface and into the clearance space. Advantageously, the wire guard is connected to the first minor surface by strut means which can be fractured or broken at the juncture of the strut means and first minor surface. After removal of the guard, the tip portions of the wire will project from the first minor surface and can be connected to further conductors.

In accordance with further embodiments, integral coupling means are mounted on the frame for coupling the frame, after removal of the wire guard, with a complementary component. The coupling means may comprise mounting posts extending beyond the plane of the first minor surface so that the frame can be mounted on a circuit board and the wires soldered or otherwise connected to conductors on the circuit board.

In accordance with further embodiments, the invention comprises an electrical harness made up of a plurality of discrete wires. The wire holder, as described above, is installed on the ends of the wires at one end of the harness so that the end portions of the wires are in aligned side-by-side parallel coplanar relationship and the cable can thereafter be processed in any desired manner to connect the wire ends to further conductors. An additional wire holder may be provided on the other ends of the wires in the cable or alternatively, the other ends might be connected to terminals in a multicontact electrical connector.

THE DRAWING FIGURES

Figure 2:
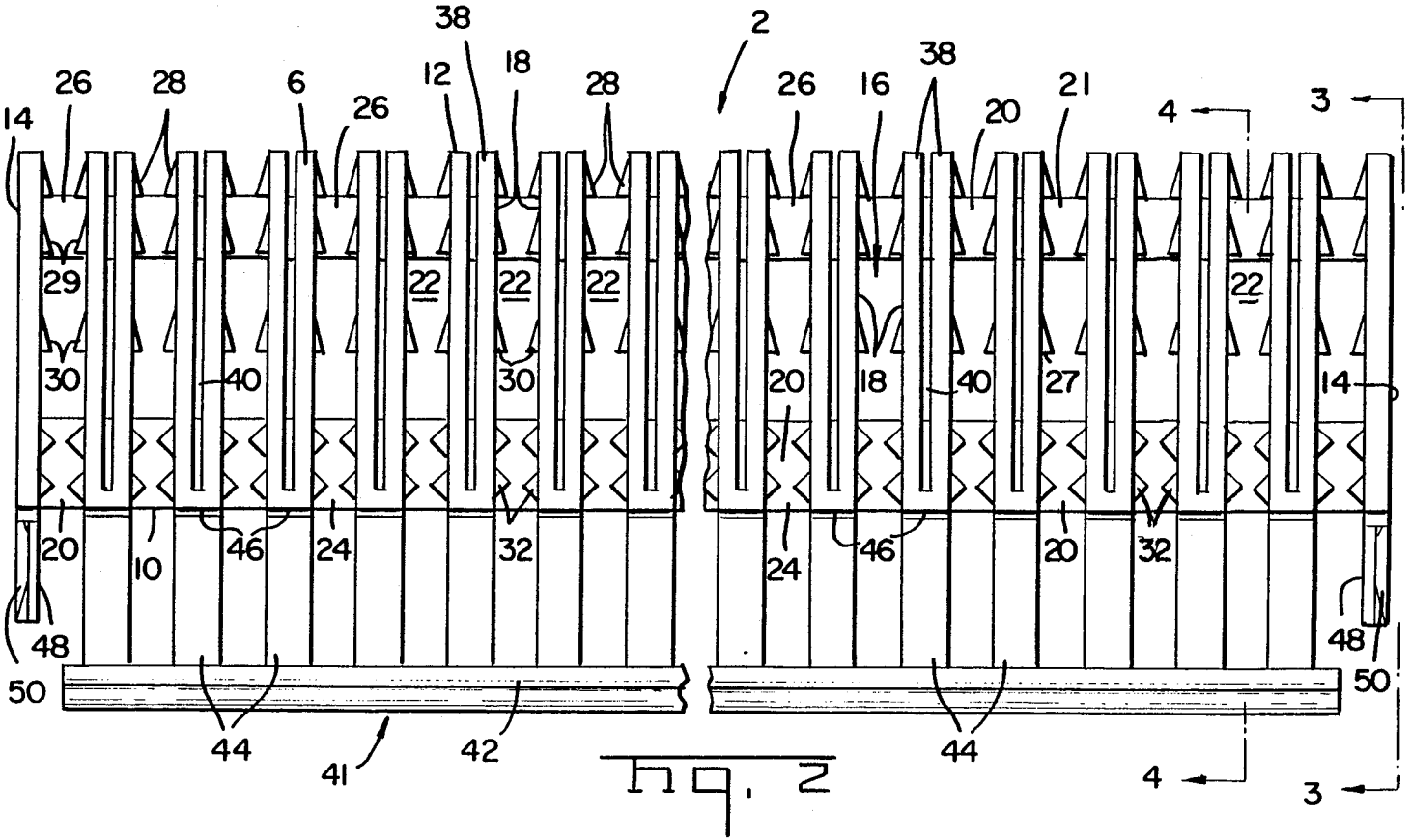
FIG. 2 is a top plan view of the wire holder of FIG. 1.
Figure 4:
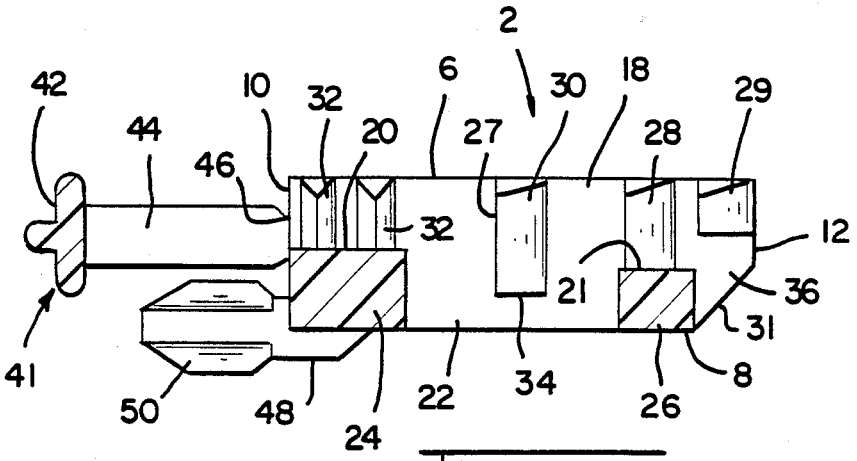

FIGS. 3 and 4 are views looking in the direction of the arrows 3—3 and 4—4 of FIG. 2.

Figure 4A:
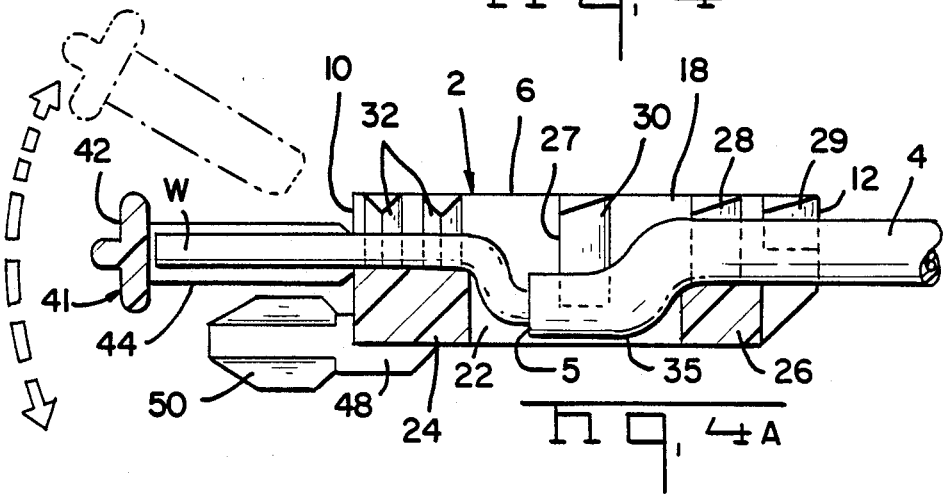
Figure 7:
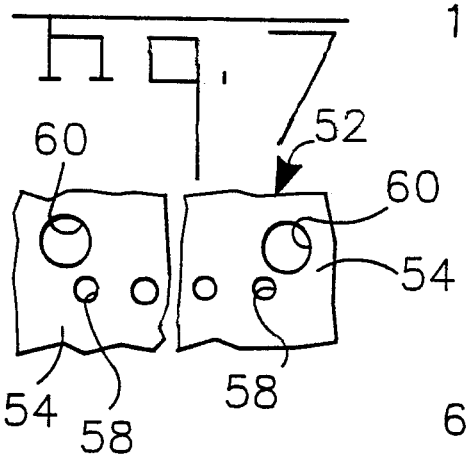

FIG. 4A is a view similar to FIG. 4 showing a wire positioned within a cavity or channel.

Figure 5:
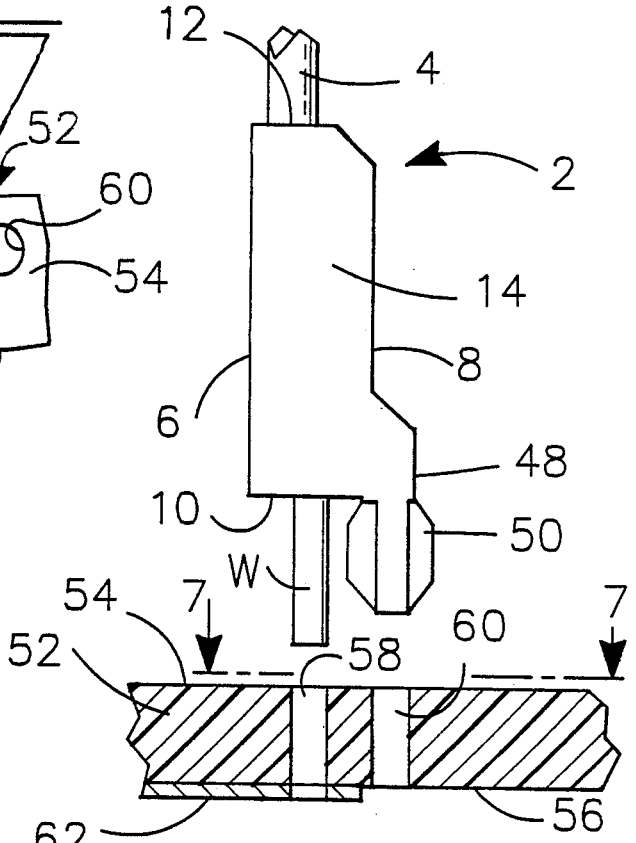

FIG. 5 is a side view of a holder having wires therein with the holder positioned above the surface of a circuit board in preparation for mounting the holder on the circuit board.

Figure 6:
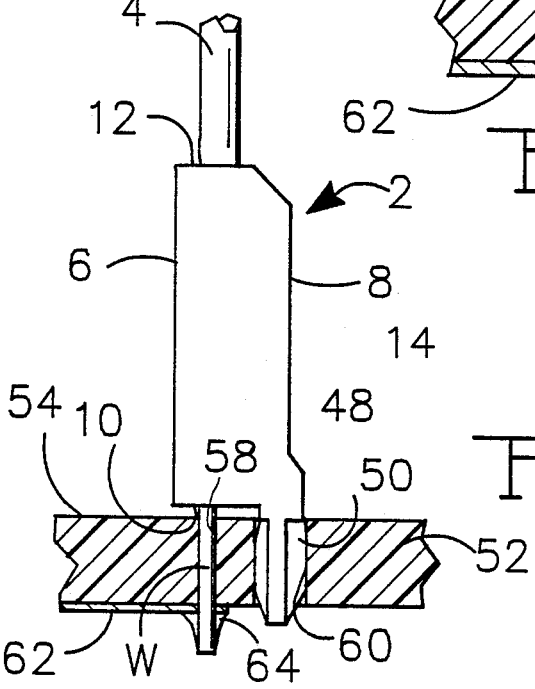
Figure 5:
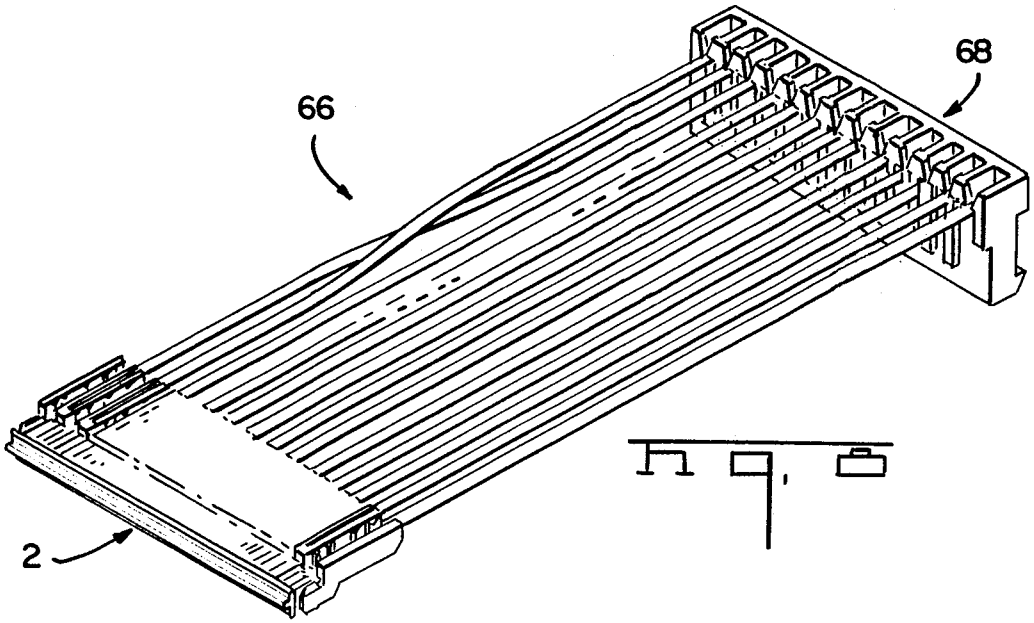

FIG. 6 is a view similar to FIG. 5 but showing the wire holder assembled to the circuit board with the wires soldered to circuit board conductors.

Figure 7:
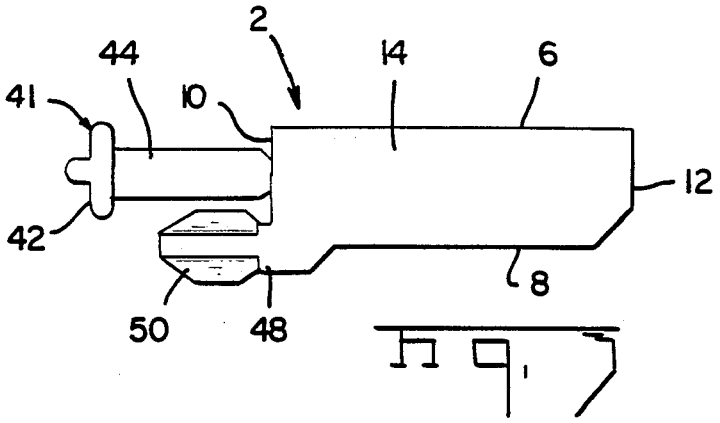

FIG. 7 is a fragmentary view of a portion of the circuit board shown in FIG. 5 looking in the direction of the arrows 7—7 of FIG. 5.

Figure 9:
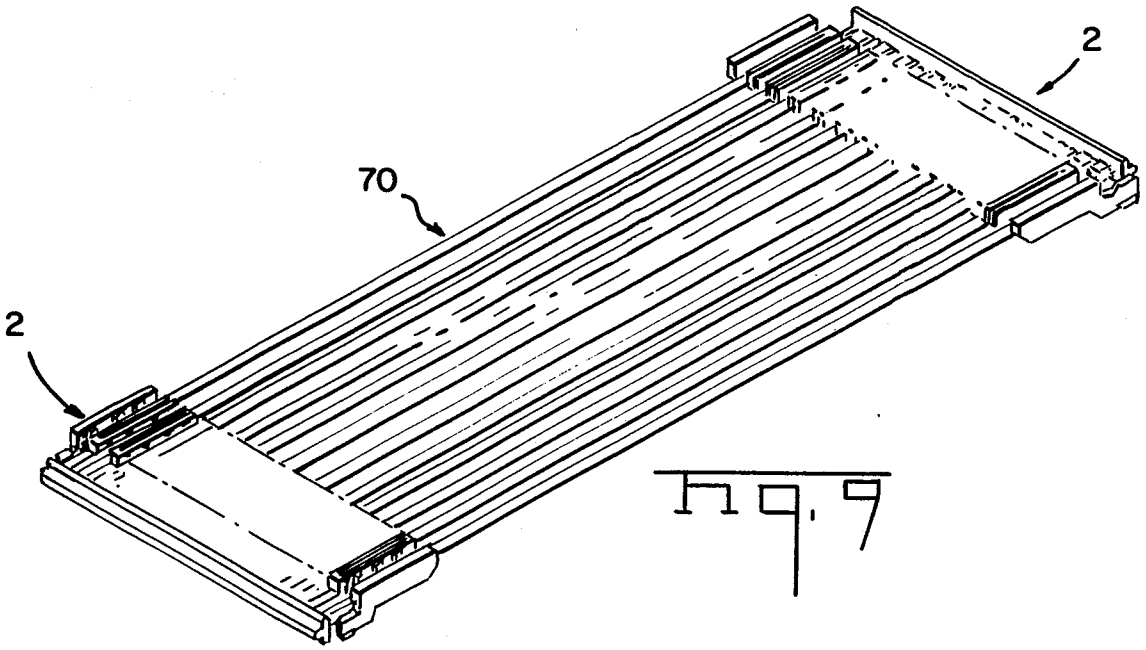

FIGS. 8 and 9 show electrical harnesses incorporating wire holders in accordance with the invention.

THE DISCLOSED EMBODIMENT

A wire holder 2 in accordance with the invention (FIGS. 1-4) is intended to receive insulated wires 4 having the insulation stripped from their end portions as shown at 5 so that each of the wires has a stripped projecting tip portion W. The wire holder 2 is of molded plastic material, such as a suitable polyester composition, and comprises a frame member 7 and a wire guard 41. The frame 7 is generally rectangular and has oppositely-facing first and second major surfaces 6, 8, oppositely-facing first and second minor surfaces 10, 12, and oppositely-facing ends 14. A plurality of side-by-side wire-receiving cavities 16 extend into the first major surface 6 and extend entirely through the frame from the first minor surface 10 to the second minor surface 12. Each cavity has cavity sidewalls 18 and cavity floor portions or inner end portions 20, 21, the floor portion 20 being adjacent to the first minor surface 10 and the floor portion 21 being adjacent to the second minor surface 12. A well 22 extends entirely through the frame portion. The well is located between the two floor portions and extends to the second major surface 8 so that two rectangular beam members 24, 26 extend continuously between the ends 14 of the frame.

The cavity sidewalls 18 have inwardly directed projections 28, 29, 30, and 32 which function as wire retaining means for retaining wires in the cavity. The projections 28, 29 and 30 are dimensioned to engage an insulated portion of the wire and they do not extend inwardly from the cavity sidewalls by as great a distance as the projections 32 which are dimensioned to engage the stripped end of the wire. The projection 29 extends only partially from the first major surface towards the second major surface and clearance space is provided at 36 so that the wires may be dressed laterally from the second minor surface 12 if desired. The projections 28 extend to the floor portion 21 while the projections 30, which are in the well portion 22, extend only partially towards the second major surface and the projections 30 have ends 34 which are spaced from the second major surfaces for reasons which will be explained below. The projections 28, 29, and 30 are in the form of inclined planes which are inclined towards the first minor surface and these projections have sides as shown at 27 which extend normally of the sidewalls. This design provides maximum resistance against removal of an inserted wire by a tensile pull on the portion of the wire which extends from the second minor surface 12.

Figure 1:
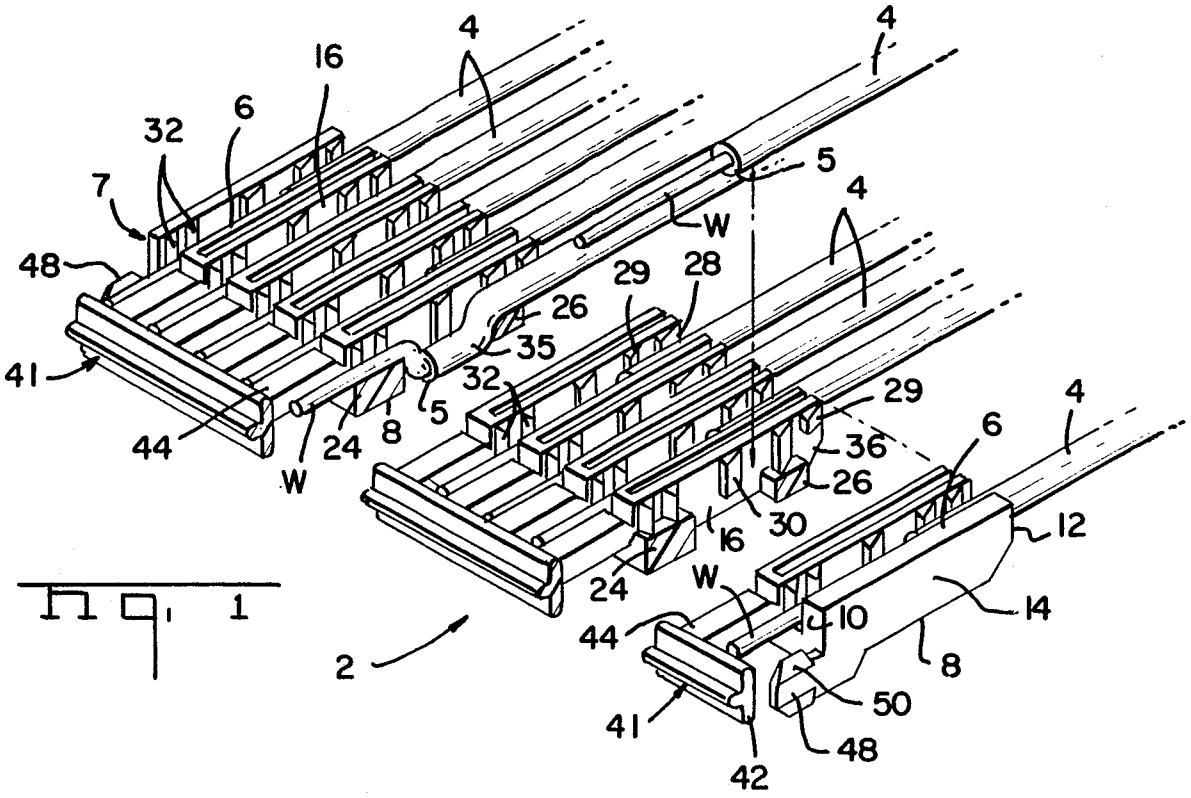
FIG. 1 is a perspective view of a wire holder, partially broken away, in accordance with the invention on the end of a discrete wire electrical cable.

It will be noted that the floor portion 20 of each cavity is relatively closer to the first major surface 6 than is the floor portion 21. As shown in FIG. 1, the floor portion 20 receives the stripped end of the wire while the floor portion 21 receives an insulated portion of the wire. By virtue of the different levels of these floor portions 20, 21, the stripped end portion of the wire is in alignment with the insulated portion of the wire which is supported on the floor portion 21.

When the wire is inserted, it is kinked in the vicinity of the well 22 as shown at 35. This kink in the wire contributes to the retention characteristics with regard to a tensile pull on the wire. In addition, the end 34 of the projection 30 is located such that the axis of the kinked portion 35 is below the end 34 of the retaining projections 30. These relationships tend to prevent lateral movement of the wire from the cavity, that is movement of the wire upwardly from the position shown in FIG. 1, by virtue of the fact that the ends 34 of the projections function as a constriction through which the wire must pass before it can be moved laterally of its axis from the cavity.

Adjacent cavities in the frame are separated by barrier walls 38 (FIG. 2) and narrow slots 40 are provided in these barrier walls. The slots 40 permit the walls between adjacent cavities to be deformed somewhat when the wires are inserted and such deformation permits the accommodation of a range of wire sizes in the holder. Under some circumstances, the insertion of wires into all of the cavities in the frame may result in a tendency of the frame to bow, and such bowing is undesirable, particularly if the wires are later connected to a circuit board as will be explained below. Any bowing effect is minimized by virtue of the fact that the wire is kinked as shown at 35 for the following reasons. The portions of the wire which rest on the floor sections 20, 21 may cause bowing of the frame in one direction, particularly if the wires are of the maximum wire gauge for which the frame is intended. However, the kinked section 35 in each wire which is adjacent to the second major surface 8 tends to cause the frame to bow in the opposite direction and the two bowing effects tend to cancel each other so that the frame will remain straight between its ends 14, notwithstanding the fact that all of the cavities have been stuffed with wires.

The wire protector 41 comprises a guard bar 42 having a T-shaped cross section which is removably connected to the first major surface 10 by spaced apart struts 44. The ends 46 of these struts are reentrant or notched as shown in FIG. 4 so that while the wire guard will be held on the frame during normal use, it can be deliberately removed from the frame by simply flexing it in one direction or the other to cause fracture at the ends 46 of the struts, the reentrant ends 46 functioning as stress raisers when the guard is flexed or swung from its normal position in the manner illustrated in FIG. 4A.

The disclosed embodiment has coupling means on the frame for coupling the frame to a complementary connector device. This coupling means may comprise mounting posts 48 which extend from the endwalls 14 of the frame laterally past the first major surface 10 and which have flexible fins 50 on their ends so that the posts can be stuffed into circuit board holes 60 as will be described below.

The wires can be inserted into the cavities of the frame in a number of different methods. Under some circumstances, the wires can be individually stripped and aligned with the help of a simple jig or fixture or simply manually aligned with the cavities and inserted with a suitable tool which will bring about the formation of the kink 35. The discrete wires 4 might also be inserted with automatic or semi-automatic machinery similar in many respects to cable making machines of the type shown in U.S. Pats. Nos. 4,136,440 and 4,043,017. Machines of the type shown in those patents have inserters for inserting wires into multicontact electrical connectors having terminals with wire receiving slots. The same types of machine, with slight changes in tooling, can be adapted to simply align the wires with the cavities in the frame and push the wires into the wire receiving cavities of the frame. The same machines frequently have means for stripping the end portions of the wires so that harness subassemblies can be produced automatically as shown in FIG. 9.

After the wires have been stripped of their insulation and inserted into the cavities of the holder, the discrete wire cable will have many of the desirable characteristics of a flat conductor cable and will, in fact, be preferable to a flat conductor cable in several respects. The discrete wires in the vicinity of the wire holder will be in parallel side-by-side coplanar relationship so that the cable can then be processed in any desired manner. The end portions W of the wires 4 which project beyond the first minor surface 10 will be in precise alignment with each other and will be protected by the wire guard 41 so that normal handling of the cable will not cause any damage or misalignment of these projecting end portions. As mentioned previously, one or more wires in the cable subassembly as shown in FIG. 1 might be of a heavier gauge than the remaining wires in the cable and the axis of the projecting end of the heavier gauge conductor will only be slightly offset from the axes of the remaining conductors.

FIGS. 5–7 illustrate the manner in which the conductors in the cable can be connected to conductors on a circuit board. The circuit board 52 has upper and lower surfaces 54, 56, and has conductors 62 on its lower surface. A row of holes 58 are provided in the circuit board for the projecting tip portions of the wires and offset holes 60 of a larger diameter are provided for the mounting posts 48 of the wire holder. After the wires have been positioned in the holder, it is merely necessary to remove the wire guard 41 and locate the wire holder above the surface 54 as shown in FIG. 5. Thereafter, the wire holder is moved downwardly to the surface 54 so that the stripped ends of the wires will enter the holes 58 and the mounting posts will enter the holes 60. The wire holder will then be firmly mounted on the circuit board by the mounting posts and the circuit board 52 can be sent through a wave soldering apparatus or the like to solder the conductors 62 to the wire ends as shown at 64. The wire holder then remains on the conductors and functions as a strain relief and alignment device for the individual wires in the cable.

As an alternative to the technique shown in FIGS. 5 and 6, the wire holder can be provided with an alternative coupling means and the wire holder can function as a connector housing which would be mated with a complementary connector having receptacle terminals dimensioned to receive the stripped ends of the wires. When the frame serves as a connector housing, the first minor surface 10 is the mating face of the housing.

FIG. 8 shows a partially completed harness 66 having a plurality of discrete wires 4 which extend from a multicontact electrical connector 68. The ends of the wires which extend to connector 68 can be connected to terminals in the connector in any desired manner, preferably by means of insulation displacement terminals. When the wires are connected to the terminals in the connector 68, they can be contemporaneously stripped of their insulation at their left-hand ends and inserted into a wire holder 2. The semi-finished harness 66 can then be subjected to further processing. For example, the guard can be removed from the holder and the wires connected to circuit board conductors as explained above. Alternatively, the wires might be individually removed from the holder 2 and have terminals of different types crimped on their ends or perhaps a number of the wires may be connected to one electrical connector while the remaining wires would be connected to a second electrical connector thereby to provide branches in the harness.

FIG. 9 shows a section of discrete wire cable having a holder in accordance with the invention at each end of the cable. As explained above, the wires can be inserted into the holders by suitable automatic machinery at a relatively low cost and the resulting cable 70 has many of the desirable characteristics of a flat conductor cable while retaining the desirable characteristics of discrete wires.

Under ordinary circumstances, the wires 4 will not cross over each other in the harness assemblies of FIGS. 8 and 9. In other words, the wires will extend to aligned corresponding positions in the connector and the holder, FIG. 8, or in the two wire holders of FIG. 9. However, cross overs can be made if they are required. For example, if an error is made during the design of a circuit board and is not discovered until the manufacture has begun, the wires in the harness can be crossed over each other to eliminate the error rather than making changes on the circuit board, an expedient which is required if flat conductor cable is used rather than discrete wires with wire holders in accordance with the present invention.

From the foregoing description, it will be apparent that there are a wide variety of applications of the present invention in the harness making industry by virtue of the fact that many of the manufacturing processes which have been heretofore reserved for flat conductor cable can now be applied to discrete wires contained in wire holders in accordance with the invention. The wire holders 2 may become part of the harness when it is put to use or the wires may be removed from the wire holder at different stages of the harness manufacturing operation and otherwise terminated, the latter procedure resulting in the holder being discarded after it has served its intended function.

I claim:

1. A wire holder for holding a plurality of discrete wires in an array in side-by-side parallel relationship, the wire holder comprising:

a frame having oppositely-facing first and second major surfaces, oppositely-facing first and second minor surfaces, and oppositely-facing ends, the major surfaces and the minor surfaces extending between the ends, a plurality of parallel side-by-side wire-receiving cavities extending into the first major surface and extending through the frame from the first minor surface to the second minor surface, the cavities being in a row which extends between the ends, the cavities having wire retaining means therein for retaining wires inserted therein, a wire guard for protecting the tip portions of the end portions of wires contained in the cavities, the guard extending beside, and being spaced from, the first minor surface, the wire guard comprising a bar like member which is connected to the frame, there being clearance space between the bar like member and the first minor surface for the reception of the tip portions of the end portions of wires held in the cavities, whereby, a discrete wire can be placed in one of the cavities by positioning the wire adjacent to the first major surface with the axis of the wire in alignment with the one cavity and with the tip portion of the end portion of the wire aligned with the clearance space, and thereafter moving the wire laterally of its axis and into the cavity so that the end portion of the wire is retained in the cavity with the tip portion of the end portion of the wire projecting from the first minor surface and into the clearance space.

2. A wire holder as set forth in claim 1 characterized in that the wire holder is of molded plastic material, the wire guard being connected to the frame by strut means.

3. A wire holder as set forth in claim 2 characterized in that the strut means and the guard are removably connected to the frame, whereby, upon insertion of the wires into the cavities and removal of the guard and strut means, the end portions of the wires will project from the first minor surface.

4. A wire holder as set forth in claim 3 characterized in that the frame has integral mounting post means therein for mounting the frame on a circuit board or the like, the mounting post means extending normally of, and beyond the plane of the first minor surface whereby the frame with the wires therein can be mounted on a circuit board and the end portions of the wires connected to conductors on the circuit board.

5. A wire holder as set forth in claim 4 characterized in that the mounting post means are integral with the frame adjacent to the endwalls thereof.

6. A wire holder as set forth in claim 5 characterized in that each of the cavities has oppositely-facing sidewalls which extend inwardly from the first major surface and a cavity floor at the inner end thereof, the wire retaining means comprising projections on the sidewalls which are dimensioned to provide an interference fit for the wire in the cavity.

7. A wire holder as set forth in claim 6 characterized in that each of the cavities has a well portion which is between the first and second minor surfaces, the well portion extending from the cavity floor to the second major surface, the well portion being dimensioned to receive a kinked portion of wire.

8. A wire holder as set forth in claim 7 characterized in that the cavity floor has a first floor portion which is adjacent to the first minor surface and a second floor portion which is adjacent to the second minor surface, the well being between the first and second floor portions, the first floor portion being relatively closer to the first major surface than the second floor portion, the holder being intended to receive insulated wires having tip portions from which the insulation has been stripped whereby, upon insertion of an insulated wire into one of the cavities with the tip portion against the first floor portion, the tip portion of the wire will be in axial alignment with an insulated portion of the wire supported on the second floor portion.

9. A wire holder as set forth in claim 8 characterized in that adjacent cavities are separated by barrier walls, each of the barrier walls having a slot therein extending inwardly from the first major surface.

10. A wire holder as set forth in claim 9 characterized in that the cavities have wires therein, the wires having kinked portions which are in the well portions, the wire guard and the struts having been removed from the frame, the end portions of the wires having tip portions which extend normally beyond the first minor surface, the wires being insulated wires, the insulation being stripped from the tip portions.

11. A wire holder as set forth in claim 1 characterized in that the wire holder is of molded plastic material, the wire guard being removable from the frame, the frame having coupling means integral therewith for coupling the frame with a complementary means whereby upon placement of wires in the cavities and removal of the wire guard, the frame having the wires therein with tip portions of the end portions of the wires extending from the first minor surface whereby the holder can function as a connector with the first minor surface being the mating face of the connector.

12. A wire holder as set forth in claim 11 characterized in that the coupling means comprises mounting posts for mounting the frame on a circuit board or the like.

13. A wire holder as set forth in claim 1 characterized in that the cavities have wires therein, the wires extending from the second minor surface of the frame to remote wire ends which are remote from the frame, the remote wire ends being connected to terminals in an electrical connector.

14. A wire holder as set forth in claim 2 characterized in that each of the cavities has oppositely-facing sidewalls which extend inwardly from the first major surface and a cavity floor at the inner end thereof, the wire retaining means comprising projections on the sidewalls which are dimensioned to provide an interference fit for the wire in the cavity.

15. A wire holder as set forth in claim 14 characterized in that each of the cavities has a well portion which is between the first and second minor surfaces, the well portion extending from the cavity floor to the second major surface, the well portion being dimensioned to receive a kinked portion of wire, the wire retaining means further comprising kink engaging means for engaging the kinked portion of wire.

16. A wire holder as set forth in claim 15 characterized in that adjacent cavities are separated by barrier walls, each of the barrier walls having a slot there extending inwardly from the first major surface.

17. A wire holder as set forth in claim 16 characterized in that the cavities have wires therein, the wires having kinked portions which are in the well portions, the wire guard and the struts having been removed from the frame, the end portions of the wires extending normally beyond the first minor surface.

18. An electrical harness of the type comprising a plurality of discrete wires, each wire having a first end portion and a second end portion, the harness comprising:

a multicontact electrical connector and a wire holder, the first end portions of the wires being connected to terminals in the connector, the second end portions being contained in a wire holder, the wire holder comprising a molded plastic frame having oppositely-facing first and second major surfaces, oppositely-facing first and second minor surfaces, and oppositely-facing ends, the major surfaces and the minor surfaces extending between the ends, a plurality of side-by-side wire receiving cavities in the wire holder, each cavity extending into the first major surface and extending through the frame from the first minor surface to the second minor surface, the cavities being in a row which extends between the ends, each of the cavities having wire retaining means therein, each of the cavities having the second end portion of one of the wires inserted therein, each second end portion entering its respective cavity at the second minor surface of the frame and having a projecting wire tip section extending from its respective cavity at the first minor surface of the frame, a wire guard for protecting the projecting wire tip portions, the wire guard comprising a bar-like member which is spaced from, and extends beside, the first minor surface of the frame, the projecting wire tip portions being in the clearance space which is between the bar-like member and the first minor surface, the wire guard being removable from the frame, each wire having its first end portion connected to a predetermined terminal in the connector and its second end portion located a predetermined cavity in the frame whereby, the second end portion of each wire is associated with a predetermined terminal in the connector, and upon removal of the wire guard from the frame, the projecting tip portions of the second end portions can be connected to further conductors in accordance with a predetermined wiring plan.

19. An electrical harness of the type comprising a plurality of discrete wires, each wire having a first end portion and a second end portion, the harness comprising:

first and second wire holders, the first end portions being in the first wire holder, the second end portions being in the second wire holder, each of the wire holders comprising a molded plastic frame having oppositely-facing first and second major surfaces, oppositely-facing first and second minor surfaces, and oppositely-facing ends, the major surfaces and the minor surfaces extending between the ends, a plurality of side-by-side wire-receiving cavities in each wire holder, each cavity extending into the first major surface and extending through the cavity from the first minor surface to the second minor surface, the cavities being in a row which extends between the ends, each of the cavities having wire retaining means therein, each of the cavities in the first wire holder having the first end portion of one of the wires inserted therein, each of the cavities in the second wire holder having the second end portion of one of the wires inserted therein, the first and second end portions of each wire having a projecting first and second projecting tip portion respectively, the projecting tip portions projecting from the first minor surfaces of their respective frames, each of the wire holders having a wire guard for protecting the wire tip portions, each of the wire guards comprising a bar-like member which is spaced from, and extends beside, the first minor surface of the associated frame member, the wire tip portions being in the clearance space which is between the bar-like member and the first minor surface, the wire guards being removably connected to the associated frame, whereby, the individual discrete wires are in side-by-side parallel coplanar relationship in the vicinity of the wire holders with each of the wire end portions being in predetermined cavities in the first and second wire holders.

20. A wire holder for securing a plurality of discrete wires in closely spaced side-by-side relationship, the wire holder comprising an insulative frame further comprising:

a plurality of barriers extending between side-by-side wire receiving channels oriented to receive wires inserted laterally of the wire axis into a first side of the channels, each channel being defined by opposed parallel sidewalls of adjacent barriers;

a pair of beams integral with the barrier walls and extending transversely along a second side of the channels, the channels being open along the second side between the beams;

first and second wire retention means in each channel, each wire retention means extending inwardly from the sidewalls to restrict the channels, the first wire retention means extending from the beams toward the first side of each channel, the second wire retention means being located between the pair of beams and spaced from the second side of each channel so that the first and second wire retention means are each spaced from the open portion of the second side of each channel; and a slot in each barrier between and parallel to each channel, whereby upon insertion of wires into each channel, the wires can be kinked below the second wire retention means to prevent withdrawal of the wires laterally of the wire axis out of the channels and the tendency of the frame to bow is reduced.

21. A wire holder for securing a plurality of discrete insulated wires each having a stripped end in closely spaced side-by-side relationship, the wire holder comprising an insulative frame further comprising:

a plurality of barriers extending from a front to a rear end of the frame between side-by-side wire receiving channels oriented to receive wires inserted laterally of the wire axis into the top of the channels, each channel being defined by opposed parallel sidewalls of adjacent barriers;

a pair of beams integral with the barrier walls at the front and rear of the frame and extending transversely adjacent the bottom of the channels, the upper surface of the beam adjacent the front of the frame being closer to the top of the frame than the upper surface of the beam adjacent the rear of the frame, the channels being open along bottom of the frame between the beams; and first and second wire retention means in each channel, each wire retention means extending inwardly from the sidewalls to restrict the channels, the first wire retention means extending from the beams toward the top of each channel, the second wire retention means being located between the pair of beams and spaced from the bottom of each channel so that the first and second wire retention means are each spaced from the open portion of the bottom of each channel, whereby the wires can be inserted into the top of the channels with the stripped ends of the wires being adjacent the front of the frame, the stripped ends resting against the upper surface of the front beam and the insulated portions of the wires rest on the upper surface of the rear beam, the stripped ends of the wires extending from the front of the channels at the same elevation at which the insulated portions of the wires extend from the rear of the channels.

* * * * *